US007346936B2

(12) United States Patent
Vargas et al.

(10) Patent No.: US 7,346,936 B2
(45) Date of Patent: Mar. 25, 2008

(54) PILATES SOCK WITH TACTILE POSTURE FEEDBACK

(76) Inventors: Stacey L. Vargas, 512 7th St., Manhattan Beach, CA (US) 90266; Kerry A. Wachtfogel, 2513 185th St., Redondo Beach, CA (US) 90278

( * ) Notice: Subject to any disclaimer, the term of this patent is extended or adjusted under 35 U.S.C. 154(b) by 147 days.

(21) Appl. No.: 11/199,847

(22) Filed: Aug. 9, 2005

(65) Prior Publication Data

US 2006/0026740 A1 Feb. 9, 2006

Related U.S. Application Data

(60) Provisional application No. 60/600,122, filed on Aug. 9, 2004.

(51) Int. Cl.
*A43B 17/00* (2006.01)

(52) U.S. Cl. ..... 2/239

(58) Field of Classification Search ..... 2/239–242, 2/409; 36/112, 113, 7.7, 7.6, 8.1
See application file for complete search history.

(56) References Cited

U.S. PATENT DOCUMENTS 2,237,652 A * 4/1941 Capezio ..... 36/8.3
2,547,812 A * 4/1951 Carabatsos ..... 36/7.7
4,069,515 A * 1/1978 Swallow et al. ..... 2/239
4,251,932 A * 2/1981 Love ..... 36/7.4
4,322,894 A * 4/1982 Dykes ..... 36/114
4,519,148 A * 5/1985 Sisco ..... 36/91
4,651,354 A * 3/1987 Petrey ..... 2/239
4,728,538 A * 3/1988 Kaspar et al. ..... 427/288
4,897,935 A * 2/1990 Fel ..... 36/7.7
5,205,071 A * 4/1993 Hergenroeder ..... 36/8.1
5,259,125 A * 11/1993 Gromes ..... 36/59 C
5,412,957 A * 5/1995 Bradberry et al. ..... 66/178 A
5,469,644 A * 11/1995 Vidler ..... 36/127
5,603,232 A * 2/1997 Throneburg ..... 66/185
5,617,745 A * 4/1997 Della Corte et al. ..... 66/178 A
5,913,592 A * 6/1999 Moore ..... 36/8.1
6,018,888 A * 2/2000 Wilkenfeld et al. ..... 36/8.3
6,138,281 A * 10/2000 Chiaruttini ..... 2/239
6,708,348 B1 * 3/2004 Romay ..... 2/239
7,107,626 B1 * 9/2006 Andrews ..... 2/239
2006/0195971 A1 * 9/2006 Lambertz ..... 2/239

* cited by examiner

*Primary Examiner*—Alissa Hoey
(74) *Attorney, Agent, or Firm*—Fulwider Patton LLP

(57) ABSTRACT

A sock used in pilates includes a medial support about an arch portion of the sock, a side support member extending longitudinally along a lateral edge, a metacarpal support member, a reinforcement member extending from a heel portion to the metacarpal support member, and a plurality of raised bumps strategically located on a lower surface to provide tactile response to weight shift and pressure due to posture that can be used to correct or adjust posture during pilates exercises.

10 Claims, 1 Drawing Sheet

10
11
12
13
14
15
16
17
18
20
21
22
23
24
25
30
31
32
2
3

PILATES SOCK WITH TACTILE POSTURE FEEDBACK

CROSS-REFERENCES TO RELATED APPLICATIONS

This application claims priority based upon U.S. Provisional Patent Application No. 60/600,122 entitled "Therapeutic Sock," filed Aug. 9, 2004, the contents and disclosures of which are fully incorporated herein by reference.

FIELD OF THE INVENTION

The present invention relates to the field of exercise footwear, and more particularly to a novel sock suited particularly for pilates exercises that provides the user with tactile posture feedback to aid in self-correcting posture irregularities when performing pilates exercises.

BACKGROUND OF THE INVENTION

Pilates is an exercise method introduced by Joseph Pilates in the 1930's to develop the body uniformly through a series of precise movements that control the body through space and stabilize it while it is working. The method was originally developed it to help strengthen and rehabilitate immobilized soldiers during World War 1. Pilates focuses on the core postural muscles that help keep the body balanced and are essential to providing support for the spine. In particular, Pilates exercises teach awareness of neutral alignment of the spine and strengthening the deep postural muscles that support this alignment, which are important to help alleviate and prevent back pain.

Pilates focuses on developing core muscle groups with controlled and concentrated movement. The body movements are combined with breathing awareness, and elements of yoga and other stretching may accompany variations of pilates. Pilates is designed to improve strength, flexibility, balance, control and muscular symmetry. The rhythmic exercises are well suited for promoting elongated and toned muscles, and are noted for developing abdomen, lower back and buttocks strength, promoting a strong body core.

A critical aspect of proper pilates exercises is correct posture, and in particular overcoming the body's natural tendency to experience pronation and supination. Pronation is the flattening out of the foot's arch when the foot bears weight. There is a natural tendency for a foot to pronate to absorb shock when the heel hits the ground, and to assist in balance during mid-stance. This results in the ankle leaning towards the inside of the foot. Even moderate pronation can be problematic, however, because the shifting of the body's weight causes increased stress on the inside or medial aspect of the foot. It pulls on the stabilizing muscles in the lower leg (posterior tibialis) and often causes the knee to shift to the inside. In extreme cases the excessive stress on the body can overcompensate for pronation and shift the ankle towards the outside causing the ankle to roll over.

Supination is the opposite effect of pronation. A foot is in supination when the ankle rotates so that weight is borne on the outside of the foot. The foot naturally supinates to take pressure off the inside of the foot, where the outside of the foot tends to be more comfortably able to provide leverage and support the body weight. However, excessive supination predisposes the ankle to injury because the stabilizing muscles on the outside of the lower leg (peroneals) are in a stretched position. It does in not take much force to cause the ankle to roll over, potentially causing ligament damage.

To eliminate pronation and supination during pilates exercises, an instructor literally must apply his or her hands to the participant to provide a tactile response that can be felt by the participant, and thereby adjust the position of the body and the feet to a proper posture position. Correct posture is a critical aspect of a pilates exercise program, but achieving and maintaining proper posture without pronation or supination is difficult without an instructor's assistance, since the participant may be incapable of self-correcting incorrect posture or even recognizing when an incorrect posture is achieved. This problem would be exacerbated in beginners or those unaware of the primary importance of proper posture. Accordingly, the prior art lacks any means of achieving the correct posture using footwear that functions in the same manner as an instructor to provide a tactile response to incorrect posture and enable self-correction of improper posture.

SUMMARY OF THE INVENTION

The above problems and difficulties are avoided by the present invention which provides a pilates sock having a plurality of resilient raised bumps of varying sizes disposed at the foot's lower surface which serve to provide feedback to the wearer as to the proper position of the foot during pilates. The sock further includes a metacarpal support band on the bottom thereof immediately behind the toe cap and a woven reinforcement strip in a substantially figure eight configuration extending along the sock sole from the metacarpal support band to the heel portion of the sock. A woven elastic support band is carried along the side or lateral peripheral marginal region of the sock sole and extends between the metacarpal support band and the heel end of the reinforcement strip. An expandable anklet band releasably retains the sock on the foot of the user.

The above described sock is of a woven unitary construction with the bands, strips and body of the sock being a single unit designed for either the right or left foot of the user. However, a separate sole insert for installation into a conventional sock is contemplated as well. Such an insert includes a similar arrangement of reinforcement bands, strips and support construction which further includes an arrangement of bumps or dimples.

Other features and advantages of the invention will become apparent from the following detailed description, taken in conjunction with the accompanying drawings which illustrate, by way of example, the features of the invention

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DETAILED DESCRIPTION OF THE INVENTION

Figures 1, 2, 3, 4:
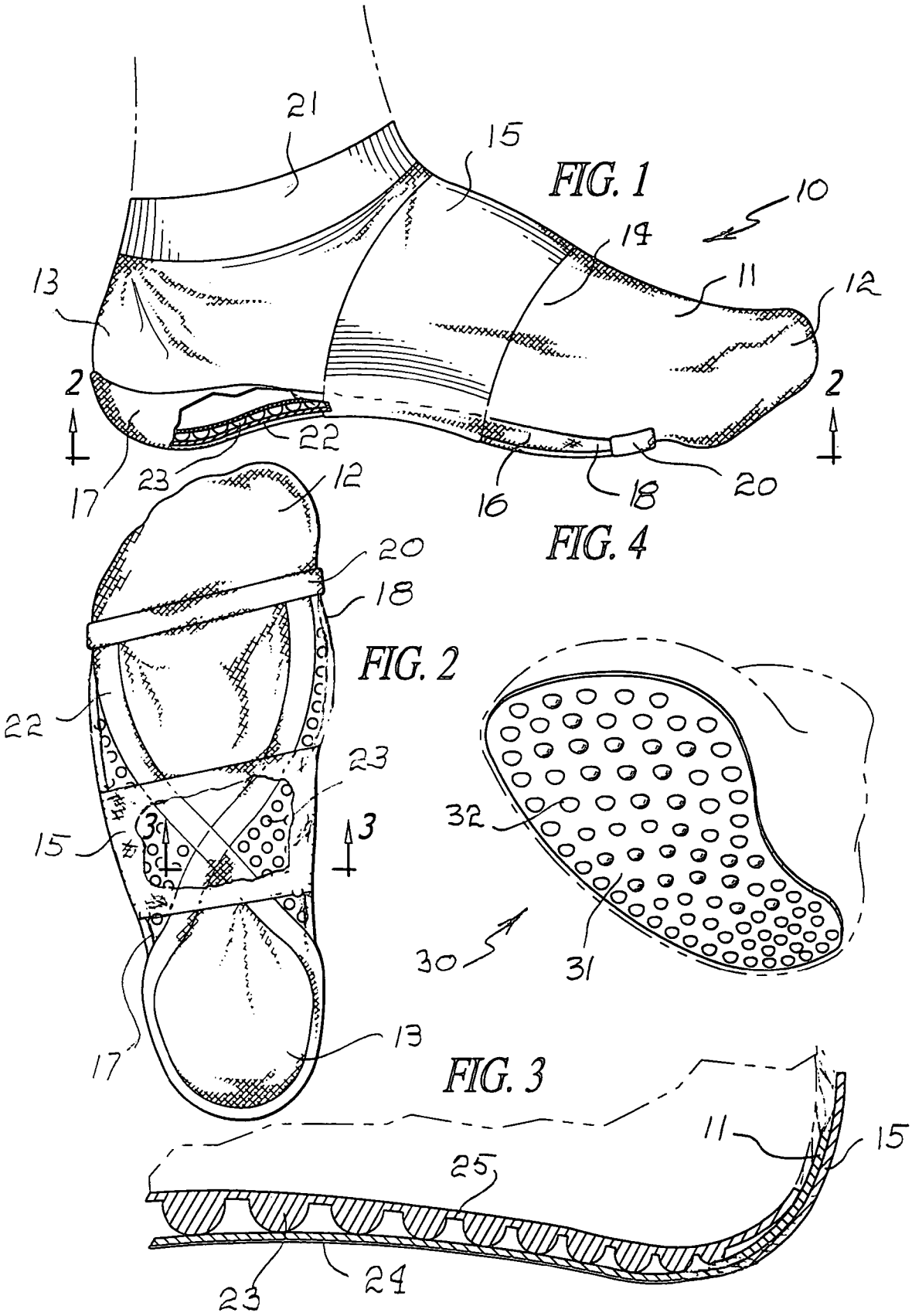
FIG. 1 is side elevational view of the novel pilates sock incorporation the present invention.
FIG. 2 is a bottom view of the sock shown in FIG. 1 as taken in the direction of arrows 2-2 thereof.
FIG. 3 is an enlarged transverse cross-sectional view of the sock taken in the direction of arrows 3-3 of FIG. 2.
FIG. 4 is a front perspective view of an optional insert placed inside the sock.

Referring to FIG. 1, the novel pilates sock incorporating the present invention is illustrated in the general direction of arrow 10 which includes a sock body 11 that is preferably woven from a 100% cotton material or material composed of a rich cotton composition. The body 11 includes a toe portion 12 and a heel portion 13 integrally coupled together by a midsection or arch portion 14. The sock body 11 includes a medial support member 15 extending over the arch of the foot at the midsection to provide support for the metatarsals and lateral cuneiform bones. A lateral edge of the sock 10 includes a band 16 from a heel end 17 to a forward end 18. At the forward end 18 is a metacarpal support band 20 extending transversely from one side of the sock to the opposite side immediately behind the toe portion 12 of body 11. The sock 10 further includes an elastic band 21 which releasably retains the sock about the ankle of the user.

A reinforcement band 22 is carried on the sole of the sock body 11 and generally forms a figure "8" on the bottom of the sock. The sock 10 further includes on a lower surface a plurality of different sized and resilient bumps 23 strategically placed at the arch of the sock. Some of the bumps 23 may extend under the heel and along the sides of the sock; however, the majority of such bumps are at the arch as shown more clearly in FIG. 2. The height of the bumps may vary according to the natural elevation of the foot during normal standing and walking. For example, the largest bumps may be concentrated at the inner arch of the foot where the foot (except in unusual cases) does not ordinarily make contact with the ground. Along the outer portion of the foot adjacent the arch, the smallest bumps would be position to account for the natural tendency for supination and the force that is regularly applied by the outside of the foot. All other lower surfaces may carry medium size bumps where the pressure is somewhat evenly applied. The three levels of bump height provide a proprioceptive feedback system that not only permits the user to determine where the pressure is being applied for a given posture, but also results in a comfortable lower surface that balances the whole foot and relieves stress and foot pain.

The bumps may be formed of a resilient polymer and applied with adhesive to the outside surface of the sock in the strategic pattern discussed above. The bumps may be carried on an outer layer 25 and downwardly depend therefrom and are integrally formed with the member. Alternatively, the bumps 32 may woven into the body of the sock. Other materials of a suitable compressibility and wear resistance will also meet the needs of the present invention.

In FIG. 2, it can be seen that the encircling medial band 15 covers the arch of the sock and that the metacarpal band 20 is immediately behind the toe section or portion 12 of the sock body 11. The reinforcement band 22, which is adjacent sock body 11, is substantially of a figure-eight configuration and extends from said metacarpal band 20 to the heel portion 13, while the lateral or side band 16 extends between the heel of the sock 13 and the metatarsal band 20.

Referring to FIG. 3, the arch of the sock is illustrated wherein it can be seen that the bumps are of varying size with the largest at the center of the sock and decreasing in size from the center to the outside or lateral edge marginal region of the sock. As further shown in FIGS. 2 and 3, the bumps terminate at the metacarpal band 20, and the heights of said raised bumps increase in the direction from a back of the sock (i.e., the heel 13) to the metacarpal band 20. The bottom of the sock includes a non-skid material 24 that is impregnated into the cotton material of the body 11.

Referring now in detail to FIG. 4, an alternate embodiment is illustrated wherein an insert is illustrated in the general direction of arrow 30 which includes a body 31 having a plurality of bumps or dimples downwardly depending therefrom. When used as an insert, the insert is placed inside the sock and assumes the place of the body 25 as shown in FIG. 3. Therefore, it is understood that the bumps and dimples can be formed in the sock or can be installed as an insert.

In view of the foregoing, it can be seen that the pilates sock of the present invention provides support and stability in order to support weak ankles and to support arches without restricting movement. The sock may be composed of a cushioned terrycloth or 100% cotton material for comfort, a smooth band 20 which will not irritate feet, and a cushioned heel that won't bunch or slide. The sock of the present invention helps stabilize weak and/or unstable ankles with a medial band support or wrap and the reinforcement strip is in a figure-eight configuration firmly supporting the foot and helping to prevent injury. With an elastic band that spans the length of the arch, the sock provides compression and support for lifting the arch to help relieve plantar fasciitis-related pain. The therapeutic sock provides the support and stability of an ankle brace in a comfortable sock.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

We claim:

1. A pilates sock having a tactile feedback system for improving posture comprising:

a sock body of resilient material to enclose a foot having a toe enclosing portion, a heel enclosing portion, and an ankle enclosing portion;

a medial support band extending around said sock body to form a closed loop;

a metacarpal support member along a bottom surface of said sock and adjacent said sock body;

a side support member extending adjacent said sock body along a lateral edge extending from said heel enclosing portion and terminating at said metacarpal support member;

a reinforcement member on an outer bottom surface of said sock, adjacent said sock body, beginning from the heel portion and terminating at the metacarpal support member; and a plurality of raised bumps of varying heights extending downwardly from areas on said sock bounded by said reinforcement member and excluding said sock body, said bumps, terminating at said metacarpal support member, said heights of said raised bumps increasing in the direction from a back of said sock to a front.

2. The pilates sock of claim 1 wherein said reinforcement member and the metacarpal support member cooperate to form a figure eight.

3. The pilates sock of claim 1 wherein said raised bumps have a height that is greater in an inner area of said arch and lower in an outer area of said arch.

4. The pilates sock of claim 1 further comprising a non-slip surface on the bottom surface.

5. The pilates sock of claim 1 wherein the medial support band is elastic.

6. The pilates sock of claim 1 wherein the bumps on the bottom surface extend from the heel portion to the metacarpal support member.

7. The pilates sock of claim 1 wherein the reinforcement member is sewn into a fabric forming the sock.

8. The pilates sock of claim 1 wherein the raised bumps are arranged to provide a tactile response to pronation and supination.

9. The pilates sock of claim 1 further comprising an elastic retaining band.

10. The pilates sock of claim 1 wherein the height of the raised bumps comprise three separate sizes.

* * * * *